US005211767A

United States Patent [19]

Shigeta et al.

[11] Patent Number: 5,211,767

[45] Date of Patent: May 18, 1993

[54] SOFT MAGNETIC ALLOY, METHOD FOR MAKING, AND MAGNETIC CORE

[75] Inventors: Masao Shigeta, Narashino; Asako Kajita, Abiko, both of Japan

[73] Assignee: TDK Corporation, Tokyo, Japan

[21] Appl. No.: 852,553

[22] Filed: Mar. 17, 1992

[30] Foreign Application Priority Data

Mar. 20, 1991 [JP] Japan ..... 3-81498
Dec. 27, 1991 [JP] Japan ..... 3-360321

[51] Int. Cl.[5] ..... H01F 1/00

[52] U.S. Cl. ..... 148/121; 164/463; 164/477; 336/213; 336/234; 148/306; 148/307

[58] Field of Search ..... 148/306, 305, 307, 121; 420/89, 117, 121; 164/463, 477; 336/213, 234

[56] References Cited

U.S. PATENT DOCUMENTS 4,812,181 3/1989 Hilzinger et al. ..... 148/121
4,881,989 11/1989 Yoshizawa et al. ..... 148/302
4,918,555 4/1990 Yoshizawa et al. ..... 360/125
4,985,088 1/1991 Okamura et al. ..... 148/305
4,985,089 1/1991 Yoshizawa et al. ..... 148/303
5,019,190 5/1991 Sawa et al. ..... 148/306
5,067,991 11/1991 Sawa et al. ..... 148/305
5,069,731 12/1991 Yoshizawa et al. ..... 148/305

FOREIGN PATENT DOCUMENTS 57-169209 10/1982 Japan .
57-193005 11/1982 Japan .
60-52557 3/1985 Japan .
63-24016 2/1988 Japan .
63-93619 6/1988 Japan .
1-39347 2/1989 Japan .

*Primary Examiner*—John P. Sheehan
*Attorney, Agent, or Firm*—Oblon, Spivak, McClelland, Maier & Neustadt

[57] ABSTRACT

Soft magnetic alloy comprising Fe, a vitrifying element (Si and B), and Cu, and containing a crystalline phase shows a low magnetic permeability of up to 3,000 at 100 kHz. Magnetic cores formed therefrom have low permeability, a wide unsaturation region, and iso.permeability without forming a gap and find application in choke coils and transformers.

17 Claims, 4 Drawing Sheets

SOFT MAGNETIC ALLOY, METHOD FOR MAKING, AND MAGNETIC CORE

This invention relates to soft magnetic alloys, method for preparing the same, and magnetic cores formed therefrom for use in choke coils and transformers.

BACKGROUND OF THE INVENTION

Choke coils are used in rectifying/smoothing circuits for smoothing an output of a switching power supply as well as normal mode noise filters. The choke coil cores are subject to a biasing DC magnetic field and an AC magnetic field is applied thereto in an overlapping manner. There. fore, the choke coil cores are required to have a wide unsaturation region of from 0 to about 25 Oe in their B-H hysteresis loop, that is, a flattened out B-H loop with low magnetic permeability. Cores having high permeability do not perform as choke coils since they are saturated with a slight change of applied magnetic field intensity.

In order that smoothing choke coils exhibit stable DC overlapping capability against any load variation and that normal mode choke coils on the primary side exhibit stable properties at power-frequency, choke coil cores are required not to lower their magnetic permeability at high current flow (or high magnetic field) and to maintain isopermeability in that permeability is approximately constant over the range of 0 to about 25 Oe. To reduce the size of choke coils, it is important that magnetic core materials have high saturation magnetic flux density and reduced losses.

Amorphous iron base alloys are promising soft magnetic materials having a high saturation magnetic flux density suitable as choke coil magnetic core materials. For example, Japanese Patent Application Kokai (JP-A) No. 52557/1985 discloses a low.loss amorphous magnetic alloy of a Fe-Si-B alloy composition having Cu added thereto. The amorphous magnetic alloy is heat treated at a temperature below the crystallization temperature for reducing core losses. However, such heat treatment is not successful in achieving low permeability and the resulting amorphous alloy has a so narrow unsaturation region that it might be saturated even at 20 Oe, suggesting that the alloy is not useful as cores. Due to its high magnetostriction, the alloy can give rise to a beat problem when formed into cores.

JP-A 39347/1989 discloses an iron base soft magnetic alloy which is prepared by heat treating an amorphous alloy for creating fine crystal grains. It is described that better magnetic properties are obtained with a grain size of up to 50 nm, most often with a mean grain size of 2 to 20 nm. The iron base soft magnetic alloy disclosed in this publication as having fine crystal grains, however, is not suitable as choke coil core material since it has too high permeability and is so narrow in unsaturation region that it can be saturated even at 20 Oe. This iron base soft magnetic alloy contains Cu and Nb or the like as essential elements in a total content as high as about 4 atom %, at which it is difficult to prepare ribbon shaped amorphous alloy.

In order to reduce the permeability of magnetic cores formed from such high permeability soft magnetic alloys, it was generally attempted to form cut cores or to form a gap in a core, thereby forming a gap radially traversing the magnetic path for flattening the B-H loop. For example, a wound core obtained by winding a soft magnetic thin strip is provided with a gap by impregnating the wound core with resin, radially cutting the core to form core segments, and mating the core segments together to form a core.

However, when the wound core is cut, the thin strip can be deformed at the cutting section so that the thin strip turns come in contact where heat generates during operation, resulting in increased losses. Further, the resin impregnation introduces stresses into the wound core, resulting in deteriorated magnetic properties and increased core losses. The additional gap forming step reduces manufacture efficiency. Magnetostriction allows generation of beat which can be amplified at the gap.

One typical method for preparing gapless low magnetic permeability cores is by partially crystallizing an amorphous alloy as disclosed in JP-A 169209/1982 and 4016/1988. The alloy of JP-A 24016/1988, however, has poor magnetic properties and increased core losses because it is crystallized only in proximity to its surface and internal stresses are induced within the alloy. The alloy compositions described in these published applications are not successful in reducing magnetostriction, so that magnetic cores formed therefrom suffer from a beat problem.

It was also proposed to reduce the permeability of alloys by forming an oxide layer on their surface. Stresses are induced within the alloys in this case too, leading to increased coercivity and eventually poor magnetic properties and increased core losses. Although low magnetic permeability is achieved by these oxide coated alloys, the alloys under a high magnetic field (or high electric current) applied have a magnetic permeability which is substantially lower than the permeability at the origin of the B-H loop, indicating that the alloys do not possess iso. permeability.

Moreover, iron base amorphous soft magnetic alloys as mentioned above have a problem in a practical frequency band of 100 kHz to 1 MHz where minor loops are drawn in an overlapping manner that effective permeability is subject to resonance due to magnetostriction when a DC magnetic field is overlappingly applied, failing to stabilize effective permeability.

SUMMARY OF THE INVENTION

A primary object of the present invention is to provide a soft magnetic alloy which possesses a high saturation magnetic flux density and low magnetic permeability suitable as the magnetic material of transformers and choke coils for use in rectifying/smoothing circuits and normal mode noise filters, has a wide unsaturation region, exhibits iso-permeability in that the magnetic permeability remains unchanged even when an intense magnetic field is applied thereto, and is subject to little resonance of effective permeability. Another object of the present invention is to provide a method for preparing such a soft magnetic alloy. A further object of the present invention is to provide a magnetic core having low magnetic permeability, iso-permeability, and low losses using such a soft magnetic alloy.

According to the present invention, there is provided a soft magnetic alloy comprising iron, a vitrifying element, and copper. The alloy contains a crystalline phase, typically 0.1 to 100% of a crystalline phase. The alloy has a magnetic permeability of up to 3,000 at 100 kHz, especially up to 1,000 at 100 kHz.

More particularly, the soft magnetic alloy is represented by the atomic ratio composition:

$Fe_{100-x-y-z}Cu_xSi_yB_z$ wherein $0.01 \leqq x \leqq 3$, $0 \leqq y \leqq 20$, $6 \leqq z \leqq 22$, and $18 \leqq y+z \leqq 30$. Preferably, $14 \leqq z \leqq 20$ and $18 \leqq y+z \leqq 29$. More preferably, $y+z \leqq 28$ and $y+z \leqq 22.5$.

In preferred embodiments, the soft magnetic alloy has iso-permeability as expressed by $\mu 25/\mu 0 \geqq 0.7$ wherein $\mu 0$ is a magnetic permeability at the origin of the B-H loop and $\mu 25$ is a magnetic permeability at 25 Oe. The crystalline phase has a mean grain size of up to 1,000 nm.

According to another aspect of the present invention, there is provided a method for preparing a soft magnetic alloy as defined above, comprising the steps of: rapidly quenching a molten alloy comprising iron, a vitrifying element, and copper, and heat treating the alloy at a temperature of 300° to 520°C.

Also contemplated herein is a magnetic core comprising a soft magnetic alloy as defined above in wound or stacked form. The core is free of a radial gap.

ADVANTAGES

The soft magnetic alloy of the present invention is prepared by heat treating an amorphous alloy of a predetermined Cu-containing, iron-base composition for crystallizing part or all of the amorphous phase. The soft magnetic alloy contains 0.1 to 100%, preferably 10 to 100% of the crystalline phase. The microscopic structure created Q by crystallization to this range, coupled with the predetermined composition, achieves low permeability suitable as the magnetic material for forming cores of transformers and choke coils for use in rectifying/smoothing circuits and normal mode noise filters, exhibits iso-permeability, prevents resonance of permeability in the practical frequency band, and shows low magnetostriction. The magnetic core formed from the soft magnetic alloy of the invention provides low permeability without forming a gap, offering a low permeability, iso-permeability core with Q minimal losses due to elimination of a gap loss. Since a gap need not be formed, the core is deteriorated in magnetic properties no longer and efficient to manufacture. Possible minor loop driving through application of an overlapping DC magnetic field also leads to small losses.

It is generally quite difficult to control the crystalline phase content to the above.defined range simply by heat treating an amorphous alloy. The inclusion of Cu allows the alloy to be heat treated at relative low temperatures for a sufficient time to precisely control the crystalline phase content to the above.defined range.

U.S. Pat. No. 4,812,181 discloses an Fe-Si-B amorphous alloy which is heat treated at 410° C. or higher for more than 10 hours for crystallizing mainly on the surface, thereby flattening the magnetization curve. This alloy is ineffective in preventing resonance and requires a long time for heat treatment.

DESCRIPTION OF THE PREFERRED EMBODIMENTS

Figure 1:
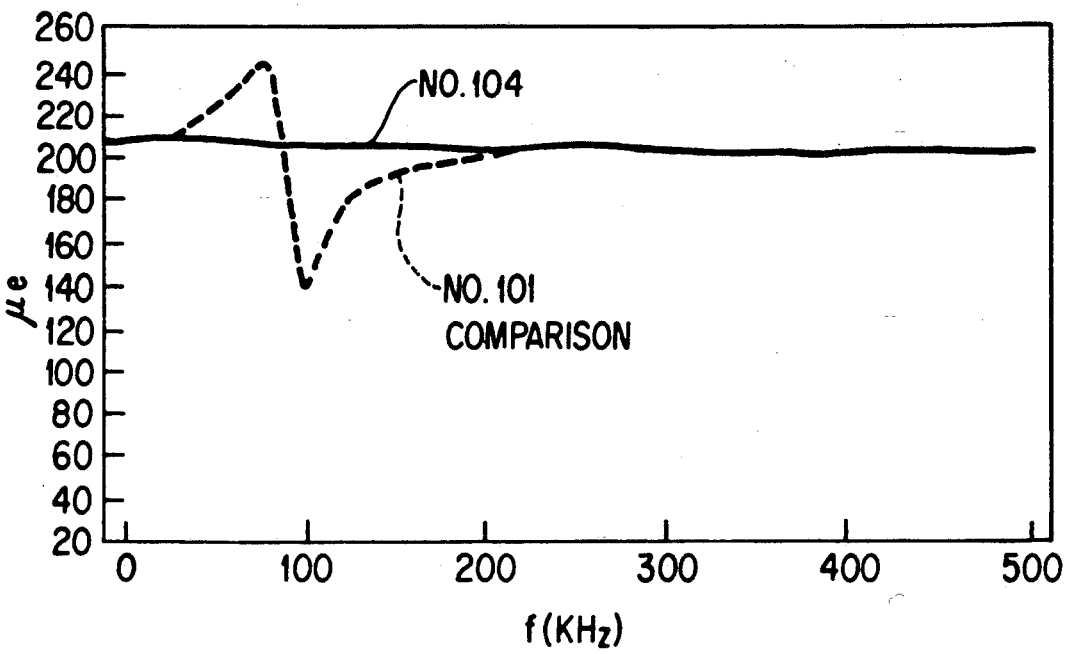
FIG. 1 is a graph showing the effective permeability $\mu e$ relative to frequency f of samples in Example 1.

The soft magnetic alloy of the present invention contains iron (Fe), a vitrifying element, and copper (Cu) and consists solely of a crystalline phase or includes a crystalline phase with the balance being an amorphous phase. The content of crystalline phase ranges from about 0.1 to 100%, preferably from about 10 to 100%. A crystalline phase content of less than 0.1% would fail to provide a desired magnetic permeability, result in a rather narrow unsaturation region and less iso-permeability, and be less effective in preventing resonance of effective permeability.

The crystalline phase content is determined by analyzing an X.ray diffraction chart as follows. In an X-ray diffraction chart of an amorphous alloy which is a source material from which the soft magnetic alloy of the invention is formed, there appears a halo indicative of the presence of an amorphous phase. Assume that this halo has a height H. On the other hand, the soft magnetic alloy of the invention has been partially or entirely crystallized. For partially crystallized alloys, a peak indicative of the presence of a crystalline phase overlaps a halo indicative of the presence of an amorphous phase. Assume that PH is the height from the bottom of the halo to the top of the peak. For entirely crystallized alloys, the halo disappears and only a peak indicative of the presence of a crystalline phase appears. Assume that this peak has a height P corresponding to a crystalline phase content of 100%. Then the crystalline phase content of partially crystallized soft magnetic alloy is calculated from these measurements according to the following formula.

$$(PH-H)/(P-H) \times 100\%$$

Copper (Cu) is included in the alloy for controlling the crystalline phase content to the above.defined range. On crystallization, the inclusion of Cu helps form fine crystal grains, leading to a lowering of permeability and magnetostriction at the same time.

For controlling the crystalline phase content to the above.defined range, the alloy should preferably have an atomic ratio composition of the following formula.

$$Fe_{(100-x-y-z)}Cu_xSi_yB_z$$

In the formula, $0.01 \leqq x \leqq 3$, $0 \leqq y \leqq 20$, $6 \leqq z \leqq 22$, and $18 \leqq y+z \leqq 30$. Preferably, $14 \leqq z \leqq 20$ and $18 \leqq y+z \leqq 29$. More preferably, $y+z \leqq 28$ and/or $y+z \geqq 22.5$.

In the formula, if x representative of the Cu content is less than 0.01, it would become difficult to control heat treating conditions for crystallization and hence, to control the crystalline phase content to the above-defined range. If x exceeds 3.0, it would become difficult to form an amorphous alloy or source alloy in ribbon form by rapid quenching because the alloy is often available in fragments. Preferably, x is at least 0.1, especially from 0.5 to 1.5.

According to the method of the invention, such a soft magnetic alloy is prepared by first rapidly quenching a melt of a source alloy by a rapid quenching technique such as a single chill roll technique for forming an amorphous alloy and thereafter, heat treating the amorphous alloy so as to create a crystalline phase. Si and B are vitrifying elements effective for making the alloy amorphous. If y representative of the Si content, z representative of the B content, and (y+z) are within the above-defined ranges, there are achieved low coercivity leading to a reduced core loss and improved iso-permeability leading to a reduction of magnetostriction. If y, z, and (y+z) are outside the above.mentioned ranges, it would be difficult to achieve such properties or to make the alloy amorphous.

In addition to Si and B, one or more elements selected from the group consisting of C, Ge, P, Ga, Sb, In, Be and As may be included as the vitrifying element. These vitrifying elements are effective for promoting amorphatization along with Si and B and adjusting the Curie temperature and magnetostriction. These vitrifying elements are preferably included in an amount to replace up to 30% of the total content of Si and B. Among others, C is most effective for improving corrosion resistance and promoting amorphatization.

The balance is iron. If desired, Fe may be partially replaced by Co and/or Ni. Co is effective for improving saturation magnetization and Ni is effective for facilitating amorphous alloy formation and saturation magnetization adjustment. The percentage of replacement of Fe by Co and/or Ni is preferably up to 50%, especially up to 20%.

In addition to the essential elements mentioned above, the soft magnetic alloy of the invention may contain another element selected from Mn, V, Cr and a mixture thereof. Mn is effective for helping crystallization, V is effective for adjusting permeability, and Cr is effective for improving corrosion resistance. The total of these additional elements should preferably be up to 3 atom %, especially up to 1 atom % because larger contents would help form finer crystal grains, leading to higher permeability. Even when these or other additional elements are included, the ranges of the Cu, Si and B contents in the formula remain unchanged.

Also, the alloy may contain at least one additional element selected from the group consisting of Ti, Zr, Hf, Nb, Ta, Mo, and W. However, the addition of these elements can not only increase permeability and reduce iso-permeability, but also requires higher heat treating temperatures for allowing a crystalline phase to precipitate, at which temperature surface oxidation is likely to occur, also resulting in poorer properties. For this reason, the total of these additional elements should preferably be less than 0.1 atom %, more preferably 0 to 0.008 atom %, especially 0 to 0.005 atom %.

In addition to the above.mentioned elements, the soft magnetic alloy of the invention may further contain any one or more elements selected from Al, platinum group elements, Sc, Y, rare earth elements, Au, Zn, Sn, and Re. The total content of these additional elements should preferably be up to 10 atom %, especially up to 1 atom % in the composition of the above-defined formula.

It will be understood that the soft magnetic alloy of the invention may contain incidental impurities such as N, O and S insofar as they do not adversely affect the magnetic properties.

The crystalline phase present in the soft magnetic alloy of the invention should preferably have a mean grain size of up to 1,000 nm, more preferably up to 100 nm, especially up to 50 nm, most preferably up to 30 nm. The lower limit is 0.5 nm, especially 1 nm. A too small crystal grain size would fail to provide low permeability and iso permeability whereas excessive crystallization to grow coarse grains would increase coercivity. The crystal grain size may be determined by means of a transmission electron microscope (TEM).

Now, the method for preparing the soft magnetic alloy according to the invention is described.

The soft magnetic alloy is generally prepared by rapidly quenching a melt of a suitable alloy composition by conventional melt spinning methods such as single and double chill roll methods, to thereby form a ribbon of amorphous alloy. Then the amorphous alloy is heat treated so that a crystalline phase is at least partially created.

In the case of rapid quenching also known as melt spinning, a ribbon of amorphous alloy is preferably produced to a thickness of 5 to 100 μm, more preferably 5 to 50 μm, most preferably 15 to 25 μm. It is rather difficult to produce an amorphous alloy ribbon of a thickness outside this range.

A ribbon of amorphous alloy prepared by a melt spinning method is heat treated in vacuum or in an inert gas atmosphere of nitrogen or argon although the heat treatment may also be carried out in air. The temperature and time of the heat treatment vary with the composition, shape, and dimension of a particular alloy, but preferably range from 300° C. to 520° C., especially from 400° to 500° C. and from 5 minutes to 100 hours, especially from 1½ to 10 hours. Outside these ranges, it becomes difficult to achieve a desired rate of crystallization, thus failing to provide desired permeability, iso-permeability, frequency response and magnetostriction constant. Particularly at higher temperatures outside the range, coarse grains would grow and surface oxidation occur, resulting in an alloy having higher coercivity beyond the acceptable level as soft magnetic alloy. The present invention employs a relatively low heat treating temperature of up to 520° C. at which degradation due to surface oxidation is minimized or eliminated, resulting in an alloy having low permeability, a wide unsaturation region, iso-permeability, and good frequency response. As compared with the Fe-Si-B system of U.S. Pat. No. 4,812,181, the heat treating time is less than one.half, that is, within 8 hours, especially within 5 hours. This is advantageous for mass production. It is to be noted that the heat treatment may be carried out in a magnetic field.

The soft magnetic alloy of the invention can find a variety of applications and is typically used as magnetic cores which are described below.

The magnetic cores of the present invention are generally embodied as wound cores for choke coils. The wound core is formed by winding a ribbon of the soft magnetic alloy. The shape and dimension of a wound core are not critical. The shape may be selected for a particular purpose from various well-known shapes including toroidal and race.track shapes. The core may be dimensioned so as to have an outer diameter of about 3 to about 1,000 mm, an inner diameter of about 2 to about 500 mm, and a height of about 1 to about 100 mm.

The heat treatment to create a crystalline phase is preferably carried out after winding an alloy ribbon. Since the heat treatment can also function to remove strains from the alloy ribbon, the heat treatment subsequent to winding prevents strains from being induced again after strain removal. The heat treatment is preferably carried out in an inert atmosphere. But, an oxidizing atmosphere such as air is acceptable because the heat treating temperature is relatively low.

The soft magnetic alloy of the invention is applicable to laminate magnetic cores as well as wound cores.

The magnetic cores of the invention are generally used in a frequency band of from the power frequency to 1 MHz, especially in a frequency band of from 10 kHz to 1 MHz when a minor loop is drawn under an overlapping DC magnetic field applied. The magnetic cores of the invention are particularly suitable for smoothing and normal mode choke coils because they have magnetic properties as mentioned below.

The cores often exhibit an effective permeability of up to 3,000, preferably up to 1,000, more preferably up to 500 at 100 kHz under zero biasing magnetic field (as measured in a magnetic field of 10 mOe). In general, the effective permeability is preferably at least 10, especially at least 20 and most preferably in the range of from 50 to 300. The biasing DC magnetic field, when overlapped, generally has an intensity of 0 to 100 Oe, often 0 to 30 Oe.

The iso-permeability of the alloy is represented by $\mu 25/\mu 0$ which is at least 0.7, preferably at least 0.8, more preferably at least 0.85, most preferably at least 0.9 wherein $\mu 0$ is a magnetic permeability at the origin of the B-H loop and $\mu 25$ is a magnetic permeability at 25 Oe.

The alloy has the frequency response that the magnetic permeabilities in the ranges of from 200 kHz to 500 kHz and 1 MHz are within ±25%, preferably within ±15%, more preferably within ±10% of the magnetic permeability at 200 kHz. Such a flat frequency response is also available over the range of from 50 Hz to 50 kHz.

As to the frequency response under an overlapping DC magnetic field applied, especially frequency response including resonance, $(\mu 500\ \mu min)/\mu 500\times 100\%$ is up to 20%, preferably up to 15%, more preferably up to 10%, most preferably up to 8% wherein $\mu 500$ is an effective permeability at 500 kHz and $\mu min$ is a minimum permeability based on resonance over 10 kHz to 500 kHz as measured under a magnetic field of 10 mOe with a biasing DC magnetic field of 20 Oe.

The alloy has a squareness ratio (Br/Bs) of up to 30%, especially up to 10%, a saturation magnetic flux density of 0 to 18 kG, especially 13 to 16 kG, and a magnetostriction constant of up to $35\times 10^{-6}$, preferably up to $20\times 10^{-6}$. Furthermore, resonance is minimized as previously described.

The wound core of the invention exhibits low permeability as defined above without forming a radial gap although a gap may be provided if necessary for facilitating winding operation. A gapped magnetic core may be prepared by impregnating a core with a thermosetting resin such as epoxy resin, thermosetting the resin to form a coating over the core, cutting the core into core segments of U, C, I or L shape, and mating core segments cut from the same core or core segments cut from different cores.

The wound core of the invention may be provided with an insulating layer between adjacent thin strips if desired.

The wound core of the invention is advantageously applied to output smoothing choke coils in switching power supplies and choke coils in noise filters, typically normal mode noise filters as well as transformer cores. The soft magnetic alloy of the invention well meets the requirements on transformer cores that they have low core losses and a permeability of about 1,000 to 3,000.

EXAMPLE

Examples of the present invention are given below by way of illustration and not by way of limitation.

EXAMPLE 1

Source alloy materials having the composition shown in Table 1 were melted and then rapidly quenched into ribbons of amorphous alloy by a single chill roll method. It is to be noted that the balance of the composition shown in Table 1 consisted essentially of Fe. The ribbons were wound into wound cores of toroidal shape having an outer diameter of 22 mm, an inner diameter of 14 mm, and a height of 10 mm. The wound cores were heat treated in nitrogen gas under the conditions shown in Table 1, completing wound core samples.

It should be understood that sample No. 101 (comparison) corresponds to the Fe-Si-B amorphous alloy heat treated according to the teaching of U.S. Pat. No. 4,812,181, sample No. 103 (comparison) corresponds to the alloy composition heat treated according to the teaching of JP-A 39347/1989, sample Nos. 104 to 107 fall within the scope of the present invention, and sample No. 102 (comparison) is a sample short of crystallization by heat treatment.

The samples were evaluated for degree of resonance of permeability by measuring the frequency response of permeability under a biasing DC magnetic field of 20 Oe (that is, DC overlapping response). Measurement was done in a magnetic field of 10 mOe over the frequency range of from 10 kHz to 500 kHz. The resonance of permeability was expressed by $$(\mu 500-\mu min)/\mu 500\times 100\%$$

wherein $\mu 500$ is an effective permeability at 500 kHz and $\mu min$ is a minimum permeability in the range of from 10 kHz to 500 kHz. FIG. 1 shows the frequency response of permeability of sample Nos. 101 and 104.

Further, the alloys were measured for saturation magnetic flux density Bs, and the wound cores measured for effective permeability $\mu e$ at 100 kHz with a biasing DC magnetic field of zero, iso-permeability expressed by $\mu 25/\mu 0$ (wherein $\mu 0$ is an effective permeability at the origin of the direct current B-H loop and $\mu 25$ is an effective permeability at 25 Oe), and squareness ratio SQ.

The crystalline phase content of the samples was calculated by the previously mentioned procedure using X.ray diffraction.

The results are shown in Table 1.

TABLE 1

| Sample No. | Alloy composition (atom %) Cu | Si | B | Nb | Heat treatment Temp. (°C.) | Time (hr.) | Crystalline phase content (%) |
|---|---|---|---|---|---|---|---|
| 101* | — | 9 | 13 | — | 460 | 10 | 10 |
| 102* | 1 | 10 | 12.5 | — | 430 | 1 | 0.05 |
| 103* | 1 | 13.5 | 9 | 3 | 550 | 1 | 99 |
| 104 | 1 | 11.5 | 16 | — | 480 | 5 | 90 |
| 105 | 0.5 | 6.5 | 18.5 | — | 450 | 3 | 30 |
| 106 | 1 | 8 | 17 | — | 470 | 3 | 20 |
| 107 | 0.5 | 9.5 | 18 | — | 490 | 3 | 98 |

| Sample No. | Bs (kG) | $\mu e$ (f = 100 kHz) | $\mu 25/\mu 0$ (%) | SQ (%) | Permeability resonance (%) |
|---|---|---|---|---|---|
| 101* | 15.6 | 250 | 30 | 34 | 30 |
| 102* | 15.1 | 5700 | satd. | 70 | satd. |
| 103* | 13.5 | 82600 | satd. | 95 | satd. |
| 104 | 14.8 | 250 | 89 | 7 | 2 |
| 105 | 14.5 | 250 | 85 | 8 | 4 |
| 106 | 14.5 | 150 | 91 | 5 | 5 |

TABLE 1-continued

| | | | | | |
|---|---|---|---|---|---|
| 107 | 14.2 | 150 | 94 | 5 | 2 |

*outside the scope of the invention

Figure 2:
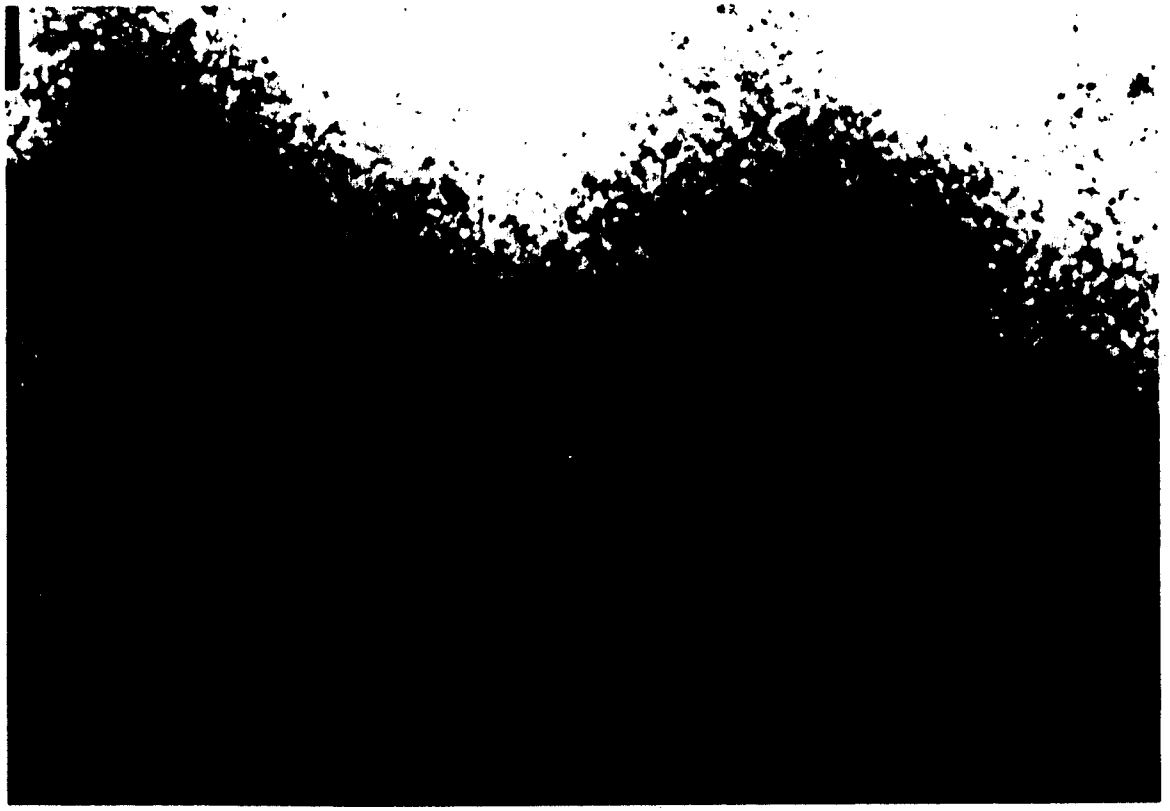
FIG. 2 is a TEM photo of the ribbon of sample No. 107 alloy in Example 1.
Figure 3:
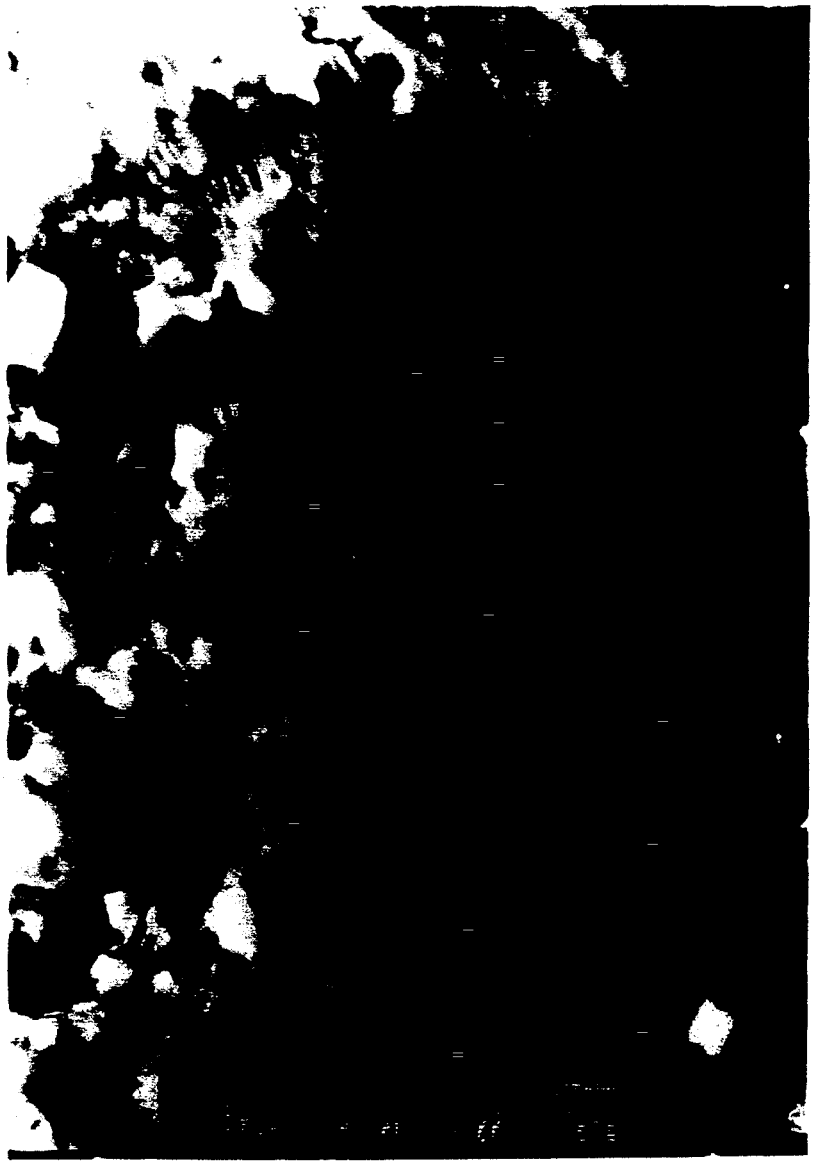
FIG. 3 is an enlarged photo of FIG. 2.
Figure 4:
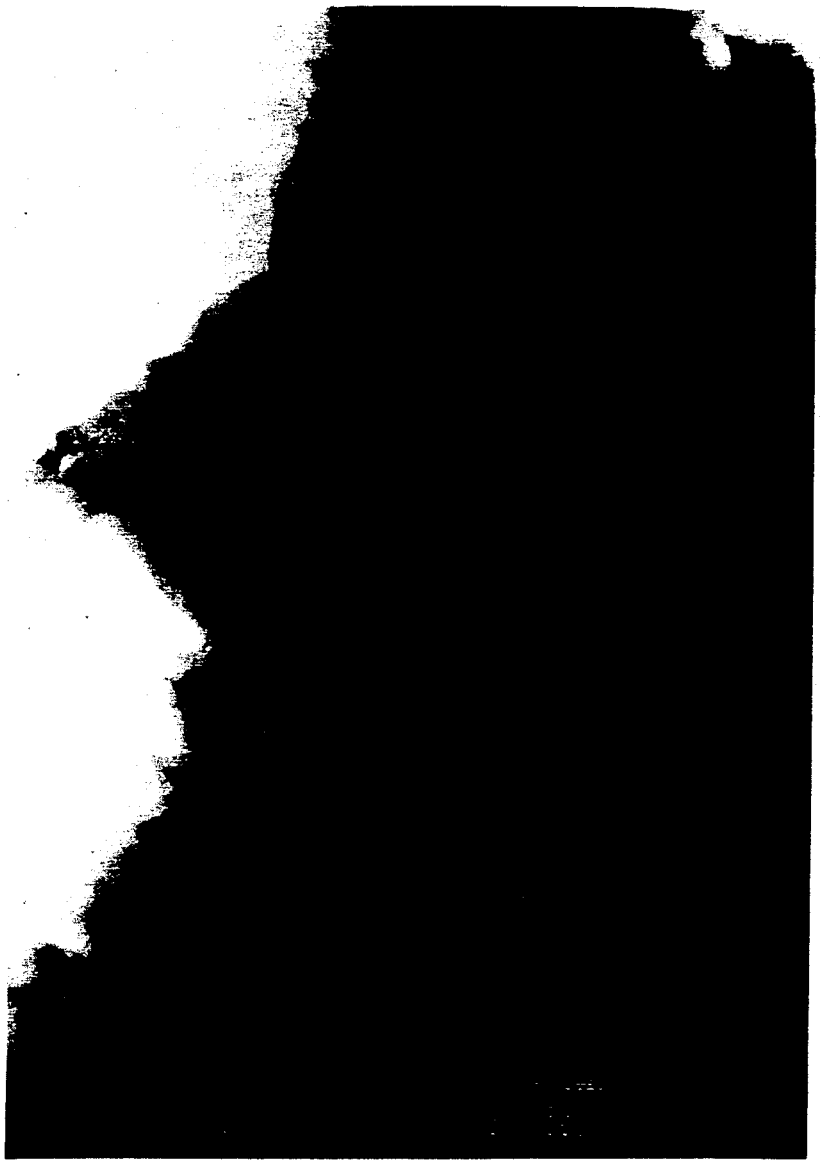
FIG. 4 is a TEM photo of the ribbon of comparative sample No. 101 alloy.

FIG. 2 is a TEM photo of the ribbon of sample No. 107 alloy at the center and FIG. 3 is an enlarged TEM photo of FIG. 2. FIG. 4 is a TEM photo of the ribbon of sample No. 101 alloy. These photos, taken together with Table 1, show that sample No. 107 contained 98% of fine crystal grains having a mean grain size of up to 50 nm whereas comparative sample No. 101 had 10% of coarse crystal grains segregated.

The effectiveness of the invention is evident from Table 1 and FIGS. 1 through 4. By heat treating iron base alloys containing an appropriate amount of Cu under appropriate conditions, there are obtained low permeability soft magnetic alloys having a microscopic structure containing a desired fine crystalline phase as shown in FIGS. 2 and 3. Wound core samples prepared by winding the soft magnetic alloys exhibit high saturation magnetic flux density, sufficiently low permeability to serve as choke coil core without forming a gap, a wide unsaturation region, good iso-permeability or no lowering in permeability even under high magnetic fields, little resonance of permeability, and flat frequency response. In contrast, alloy samples having a crystalline phase content or a composition outside the scope of the invention were subject to substantial resonance of permeability as seen from Table 1 and FIG. 1.

Approximately equivalent results were obtained when 0.01 atom % of at least one element selected from Mn, V, and Cr was added to the samples of Table 1. Addition of 0.1 atom % or more of Mn, V or Cr was acceptable while the addition of 0.1 atom % or more of Ti, Zr, Hf, Nb, Ta, Mo or W was unacceptable because of increased permeability.

EXAMPLE 2

Figure 5:
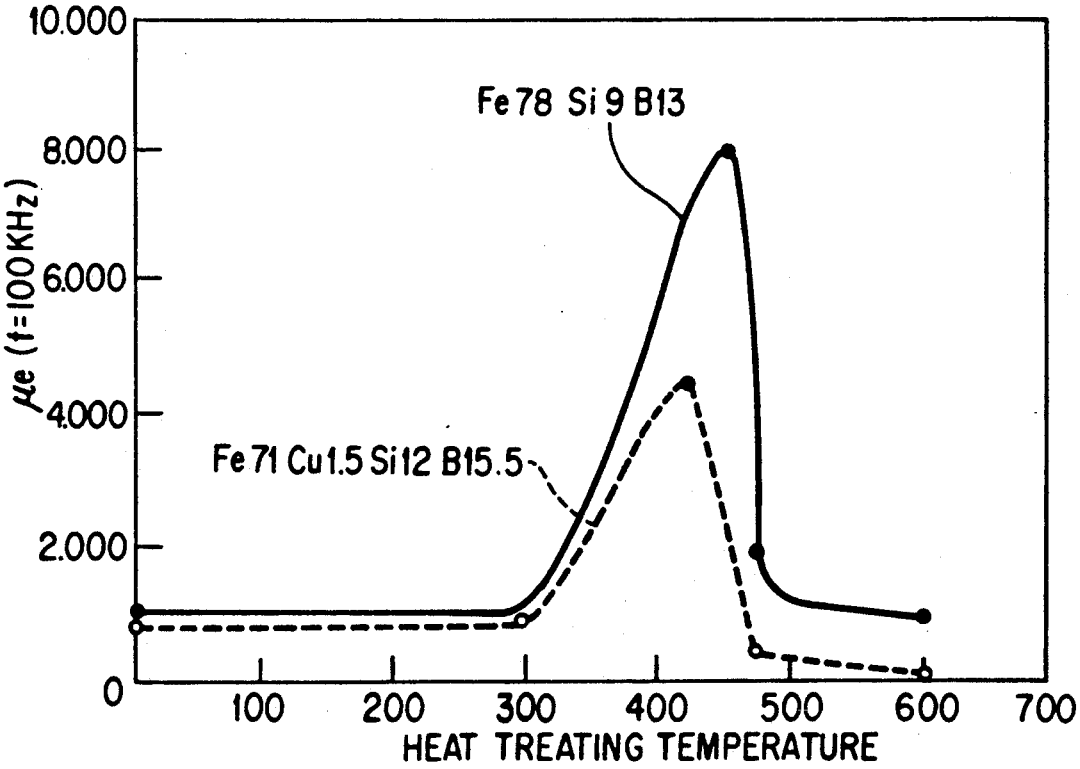
FIG. 5 is a graph showing the effective permeability $\mu e$ relative to heat treating temperature of samples in Example 2.

A source alloy material having the atomic ratio composition $Fe_{71}Cu_{1.5}Si_{12}B15.5$ was melted and then rapidly quenched into a ribbon of amorphous alloy by a single chill roll method. The ribbon was wound into a wound core as in Example 1 and heat treated in nitrogen gas. The heat treating time was 90 minutes. A series of wound core samples were prepared by varying the heat treating temperature. FIG. 5 shows the effective permeability $\mu e$ of the wound core samples at 100 kHz relative to the heat treating temperature.

For comparison purposes, the relationships of $\mu e$ to the heat treating temperature were examined by processing an alloy of atomic ratio composition $Fe_{78}Si_9B_{13}$ as described above. These relationships are also depicted in FIG. 5.

FIG. 5 indicates the effective range of heat treating temperature to produce soft magnetic alloys within the scope of the invention. When heat treated at a temperature in excess of 600° C., the coercive force of $Fe_{71}Cu_{1.5}Si_{12}B_{15.5}$ alloy increased to about 80 Oe or higher.

The soft magnetic alloys of the present invention exhibit high saturation magnetic flux density, low permeability, a wide unsaturation region, good iso-permeability or no lowering in permeability even under high magnetic fields applied, little resonance of permeability, and flat frequency response of permeability. Therefore, the alloys are applicable to cores of transformers and choke coils for rectifying/smoothing circuits and normal mode noise filters without forming a gap. Low permeability magnetic cores with extremely low losses are manufactured in an efficient manner. Over the practical frequency band of from 10 kHz to 1 MHz, the permeability of the cores is subject to no or little resonance when a DC magnetic field is overlappingly applied. Thus the cores have stable performance as designed.

While the invention has been described in what is presently considered to be a preferred embodiment, other variations and modifications will become apparent to those skilled in the art. It is intended, therefore, that the invention not be limited to the illustrative embodiments, but be interpreted within the full spirit and scope of the appended claims.

We claim:

1. A soft magnetic alloy containing 0.1 to 100% of a crystalline phase and having a magnetic permeability of up to 3000 at 100 kHz consisting of iron, boron, copper, a total of from 0 to 0.008 atom % of at least one element selected from the group consisting of Ti, Zr, Hf, Nb, Ta, Mo and W, a total of from 0 to 3 atom % of at least one element selected from the group consisting of Mn, V and Cr, and, optionally, one or more elements selected from the group consisting of Si, C, Ge, P, Ga, Sb, In, Be and As.

2. A soft magnetic alloy of claim 1 which is represented by the atomic ratio composition:

$$Fe_{100-x-y-z}Cu_xSi_yB_z$$

wherein $0.01 \leqq x \leqq 3$, $0 \leqq y \leqq 20$, $6 \leqq z \leqq 22$, and $18 \leqq y+z \leqq 30$.

3. The soft magnetic alloy of claim 2 wherein $14 \leqq z \leqq 20$ and $18 \leqq y+z \leqq 29$.

4. The soft magnetic alloy of claim 2 wherein $0.5 \leqq x \leqq 1.5$.

5. The soft magnetic alloy of claim 3 wherein $y+z \leqq 28$.

6. The soft magnetic alloy of claim 5 wherein $y+z \geqq 22.5$.

7. The soft magnetic alloy of claim 1 wherein provided that $\mu 0$ is a permeability at the origin of the B-H loop and $\mu 25$ is a permeability at 25 Oe, $\mu 25/\mu 0 \geqq 0.7$.

8. The soft magnetic alloy of claim1 having a permeability of up to 1,000 at 100 kHz.

9. The soft magnetic alloy of claim 1 wherein said crystalline phase has a mean grain size of up to 1,000 nm.

10. A magnetic core cmprsiing a soft magnetic alloy as defined in claim 1 in wound or stacked form.

11. The core of claim 10 free of a radial gap.

12. The core of claim 10 which is used in a choke coil or transformer.

13. A magnetic core comprising a soft magnetic alloy as obtained by the method of claim 4 in wound or stacked form.

14. The core of claim 13 free of a radial gap.

15. The core of claim 13 which is used in a choke coil or transformer.

16. The core of claim 10 or 13 wherein $(\mu 500-\mu min)/\mu 500 \times 100\%$ is up to 20% wherein $\mu 500$ is an effective permeability at 500 kHz and μmin is a minimum permeability based on resonance over 10 kHz to 500 kHz as measured under a magnetic field of 10 mOe with a biasing DC magnetic field of 20 Oe.

17. A method for preparing a soft magnetic alloy as defined in claim 1 comprising the steps of:

rapidly quenching a molten alloy consisting of iron, boron, copper, a total of from 0 to 0.008 atom % of at least one element selected from the group consisting of Ti, Zr, Hf, Nb, Ta, Mo and W, a total of from 0 to 3 atom % of at least one element selected from the group consisting of Mn, V and Cr, and, optionally, one or more elements selected from the group consisting of Si, C, Ge, P, Ga, Sb, In, Be and As, and heat treating the alloy at a temperature of from 300° to 520° C.

* * * * *